United States Patent [19]

Franklin

[11] 3,942,618

[45] Mar. 9, 1976

[54] ROLLERWAY FOR HANDLING MOLDING APPARATUS

[76] Inventor: James W. Franklin, P.O. Box 3646, Albuquerque, N. Mex. 87110

[22] Filed: Apr. 4, 1974

[21] Appl. No.: 457,740

Related U.S. Application Data

[63] Continuation-in-part of Ser. No. 214,699, Jan. 3, 1972, Pat. No. 3,826,057.

[52] U.S. Cl. ..... 193/35 R; 249/18; 425/62

[51] Int. Cl.[2] ..... B65G 13/12

[58] Field of Search ..... 425/62; 249/13–20; 280/79.1, .79.3, 79.2; 193/35 R, 37; 52/690–691, 693–694; 308/20

[56] References Cited

UNITED STATES PATENTS

| | | | |
|---|---|---|---|
| 1,777,694 | 10/1930 | Halteman | 280/79.1 |
| 1,813,373 | 7/1931 | Wooldridge | 52/691 |
| 2,575,968 | 11/1951 | McCallum et al. | 280/79.1 |
| 3,263,951 | 8/1966 | Stokes | 193/35 |
| 3,450,280 | 6/1969 | Colwot | 249/19 |
| 3,579,759 | 5/1971 | Zuccolo | 425/62 |
| 3,785,109 | 1/1974 | Letourneur | 52/690 |

*Primary Examiner*—R. J. Shore
*Assistant Examiner*—John McQuade
*Attorney, Agent, or Firm*—C. B. Messenger

[57] ABSTRACT

Handling equipment is provided to facilitate the placement, removal and repositioning of large form sections that are supported by a plurality of composite trusses. The trusses themselves are made up of chords, struts, couplers, connectors and brace components of standard sizes cooperatively interconnected to provide composite trusses that may be of various length and height. Deck panels and supports therefor are mounted on a plurality of trusses to provide a complete section of forms that is used and moved unitarily. The job site longitudinal movement of sectional forms of large size is aided through use of a plurality of tilting form glides while cross dollies provide unidirectional or multidirectional movement patterns for trusses which they support. One tilting form glide component provides distributed loading support for the chords of trusses as the sectional forms are moved longitudinally or outwardly past the edge of a building, or it can optionally provide, together with cross truck and track components, a lateral moving capability for the form sections.

2 Claims, 8 Drawing Figures

ROLLERWAY FOR HANDLING MOLDING APPARATUS

CROSS-REFERENCE TO RELATED APPLICATION

The present application is a continuation-in-part of application Ser. No. 214,699 filed Jan. 3, 1972 now U.S. Pat. No. 382,6057, entitled "Truss System".

BACKGROUND OF THE INVENTION

Various truss systems have been designed and fabricated previously for use in building construction. A primary usage of composite type trusses has been in the construction of buildings as roof and deck supports. It is acknowledged that others have devised and provided components that could be used interchangeably in trusses of different size, length and design strength. Usually such interchangeable components are combined with custom made top and bottom chord elements that are individually fabricated for the separate job site installation. In addition to the uses of truss systems in permanent building installations, a more recent and extensive use of trusses has developed in connection with the fabrication of roof and deck forms for reinforced concrete construction. In such usage trusses of selected length have been used as supports for a section of deck or roof forms. The sectional forms are intended to be used repeatedly at a job site, and, accordingly, the truss and form combination provides an assembly that may be moved conveniently as a unit from a first pour site to subsequent pour locations. The form handling equipment provided is adapted for engagement with the lower chords of the truss sections so the trusses can be moved therealong or together with the form handling equipment. When the form sections are to be moved to subsequent pour locations at a higher elevation of the building, tilting form glides are positioned adjacent the edge of the form supporting floor, and the form sections are moved longitudinally to a position extended past the supporting floor for engagement by cables of hoist apparatus. Rollers of the form glide which directly engage the lower chords of the trusses can provide full support for the entire form section. The loadings on the trusses can be quite severe during such operations, and multiple rollers on a tilting base are proposed to avoid concentrated loadings of the trusses as the form sections are so extended. At a job site the large form sections often have to be moved laterally to avoid obstructions. Cross dollies provide a non-directional movement pattern for the forms. Also, one tilting form glide is adapted for use with a cross truck assembly in such manner that longitudinal and lateral movement patterns are possible.

SUMMARY OF THE INVENTION

The present invention provides a truss system in which the trusses to be used in permanent building installations or as form supports can be fabricated at the job site to meet widely varying requirements through use of standard components. Chords, struts, coupler and brace element pieces may be combined with the same or interfitting components to provide chrods and struts of shorter or extended operative length. Through use of close interfitting and efficient load transmitting joints, the assembled trusses may be used to span long or short distances and to withstand widely varying load requirements. Both the top and bottom chords are of the same size and construction.

These elements provide socket receptacles at spaced intervals adapted to receive the web or strut components that may be inserted and closely fit with respect thereto. Fastener openings are provided on a rigidly controlled schedule to assure efficient intercoupling of such components. Couplers may be used to join chord elements together in end to end relation to change the overall span for the trusses being assembled. Accordingly, through use of standard components, trusses of 25, 50, 100 or more feet may be fabricated in modular increments of 5 feet. Similarly, the height of any truss assembly may be modified to meet increased load or height requirements. By reason of these adaptability features, a contractor having the basic truss components can adapt on-hand equipment to meet new and changing job requirements. Assembled trusses can be easily handled at the job site or when being moved away therefrom. A plurality of trusses can be efficiently joined and cross-braced at a job site to provide support for an assembled form section that can thereafter be efficiently moved from a first to subsequent pour locations. Where a plurality of trusses are joined together with additional elements to provide a deck form section, it is beneficial if the entire assembled form section can be moved from one pour site to the next without disassembly. If the forms are used to support roof and deck components of poured concrete, the form sections will usually be moved to a next pour location at a different elevation. Form glide components having bearing mounted rollers are provided that can be placed under the bottom chord of the trusses to facilitate reciprocal movement of the trusses and, accordingly, of the entire form section. If the form glides are positioned adjacent the edge of a building, more than half of the total form section can be extended past the edge of the building. A multi-roller glide is provided on a tilting base to reduce the effects of concentrated loadings on a truss where the point of support moves between successive panel points. The form glides may be used together with cross dollies to provide lateral movement capabilities, or components of the form glide can be used with a cross truck that moves on a supporting deck or on a guide track to facilitate lateral movement of the form sections in a manner that will free the form sections from points of interference with supporting pillars or other obstructions.

DESCRIPTION OF THE PREFERRED EMBODIMENTS

Figure 1:
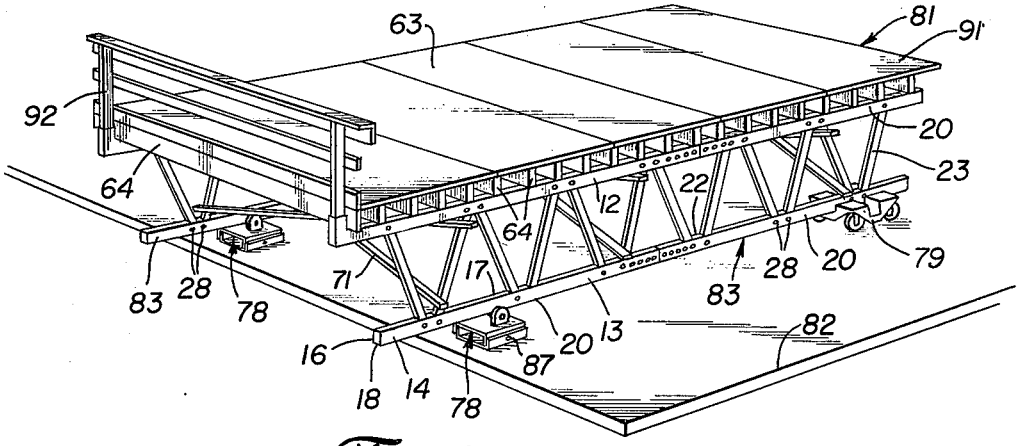
FIG. 1 is a perspective illustration showing usage of components of this invention.

Embodiments of the invention are shown in the accompanying Figures. In FIG. 1 composite truss 83 is shown. This truss, which has a total length of 35 feet, is made up of a plurality of truss or chord components joined each to each. Separate chord components each identified by the numeral 20 make up the top chord 12 and the bottom chord 13.

The chord elements are made of rectangular tubing having flanges or sidewalls 14 and 16 and top and bottom webs or edges 17 and 18. At 5-foot intervals the top web is punched completely out to provide paired chord openings separated by a tie strap 22, the center line of which is spaced exactly five feet from the next adjacent tie strap 22. The openings thus provided are adapted to receive and snugly engage the exterior sides of strut pieces 23, all of which are of identical length. The strut pieces 23 have holes drilled transversely through the struts in position a slight distance away from the ends of the struts. With this arrangement the struts are received in the chord openings, and the strut holes are brought into registration with holes drilled transversely through the sides 14 and 16 of the chord component 13. A plurality of pins 28 are provided for engagement through the chord holes and the aligned strut holes of the separate struts 23 to provide the assembly as shown in FIG. 1. All of the holes are of a closely regulated diameter adapted to receive and snugly engage the pins 28.

Trusses made up utilizing the described standard components may be conveniently used in building construction to provide trusses of length adapted to any building size in modular 5-foot increments. The trusses may also be conveniently used in concrete forming operations for the support of form sections that are to be moved repeatedly to various pour locations. Such a form section is shown in FIG. 1. Here the completed form section 81 is inclusive of a plywood deck 91 made up of a plurality of separate pieces of plywood 63 laid in flat side by side relation and joined to supporting joists 64 or other supports. A pair of trusses made in accordance with this invention are disposed beneath the joists with the top chords 12 of the trusses being joined to the joists 64. The top and bottom chords 12 and 13 are joined together by a plurality of struts 23 and the associated pins 28. The trusses themselves provide a rigid structure and secure support for the deck form section 91. Since the length of the strut combinations used may be changed over a wide range, the total height of the truss can be regulated to provide convenient support for the next deck that is to be poured above a ground support or an already poured deck. Where an 8-foot ceiling space is to be provided, trusses of 5 or 6-foot height may be conveniently used.

In practice the form sections are made up at a specific job site with the deck form components joined securely to the trusses. With this arrangement the trusses and deck may be moved unitarily at the job site from one pour location to the next. To facilitate such job site movement and further to speed the placement or removal of the entire form section 81, the lower chord may be joined to roller supports so that the entire form section may be moved horizontally along a supporting deck to its pour locations.

Figure 5:
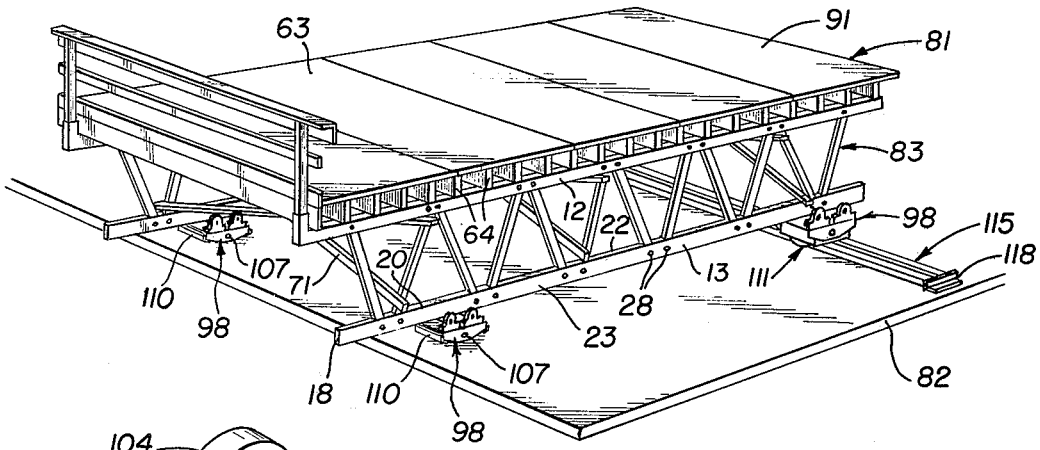
FIG. 5 is a perspective illustration similar to that of FIG. 1 showing usage of additional form handling equipment.
Figure 6:
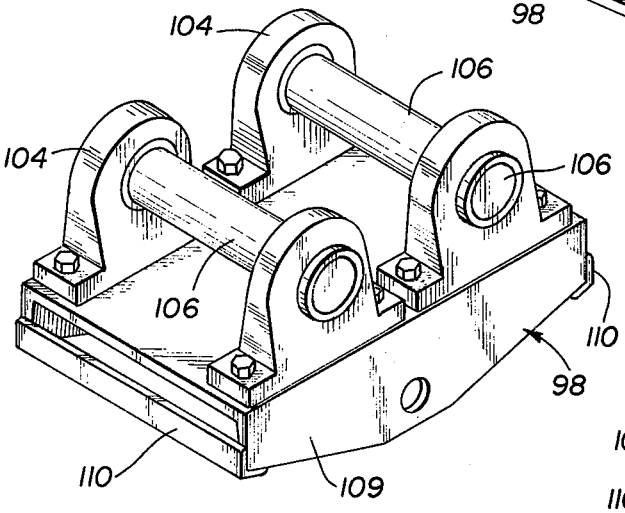
FIG. 6 is a perspective view showing the tilting form glide less the channel support of FIG. 4.

Except in instances where a single truss might be used to provide support for the pouring of a girder, a plurality of trusses will ordinarily be used for the support of form sections. To provide lateral support for the trusses, cross braces are used. A cross brace system is shown in FIGS. 1 and 5 joining separate trusses. A cross brace system is made up of identical cross braces 71 which extend from a top chord of one truss to the bottom chord of the adjacent truss. A type of telescoping tubing has been conveniently used for these cross braces 71.

Figure 2:
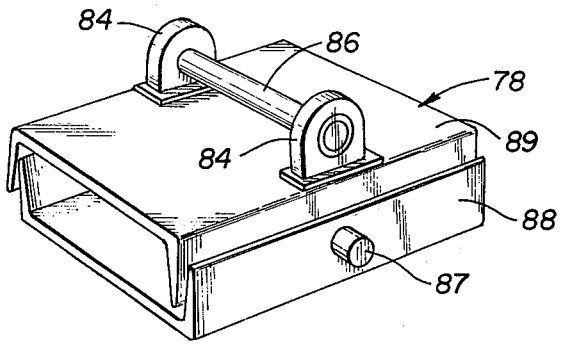
FIG. 2 is a persepctive view illustrating a roll-out support.

Additional features of a combined truss support and form support system and of specific equipment items used in conjunction therewith are shown in FIGS. 1–8 presented herewith. In FIG. 2 a first type of tilting form glide 78 is illustrated. This unit may be used together with the cross dolly 79 shown in FIG. 3 when a form section, such as the form section 81, is being moved from a building level above which a floor has already been poured to a higher building level that is yet to be formed. In connection with such operations the entire form section 81 is moved laterally or in angular directions on its cross dolly supports 79 to an edge of a supporting slab 82. The cross dollies 79 may be used at all four corners of a form section 81; or when the form section is to be moved, it may be installed at a central or balanced position along the length of an assembled truss 83. If positioned at the center, the entire form section can be rocked on the central cross dolly 79, and thereafter the tilting form glide 78 of FIG. 2 may be placed under the lower chords 13 for the trusses 83. With the tilting form glide 78 positioned adjacent the edge of the already poured slab 82, the lower chords, the entire trusses 83 and form section 81 may be moved in endwise direction outwardly to overhang the poured slab. Bearing supports 84 and a roller 86 are provided on tilting form glide 78 to facilitate longitudinal movement of the truss chords and, accordingly, of the entire truss section 81. A lower pivot 87 joins two channel sections 88 and 89 of the tilting form glide 78 together in a manner facilitating tilting movement of the top channel section 89 with respect to its lower channel support 88. This tilting feature facilitates handling of the assembled truss section 81 and permits removal of the cross dolly 79 when a substantial portion of the weight of the form section 81 is cantilevered outwardly past the tilting form glide 78. Where an overhead deck has already been poured, the truss section 81 can actually be extended a distance greater than half its length, since the upper decking 91 can be moved into contact with the already poured deck positioned thereabove. In such extended position cable slings may be attached to the form section 81 or to the hand rail 92 and other components thereof, and the form section as a unitary whole may be raised to its next pour location.

Figure 3:
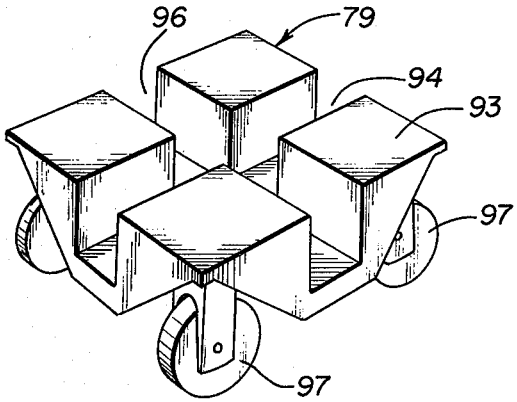
FIG. 3 is a perspective illustration showing a cross dolly.

The cross dolly illustrated in FIG. 3 provides a bed 93 having cross slots 94 and 96, either of which are adapted to engage and snugly receive a chord element of the truss system. A plurality of swivel wheels 97 are provided so that the cross dolly can actually be moved in any direction. The cross slots facilitate convenient engagement with the chords of trusses and provide a minimum clearance type of support therefor. In installations where chords of different size may be used, the slots 94 and 96 can be of varied width to provide secure engagement. For many installations a plurality may be used, the slots 94 and 96 can be of varied width plurality of cross dollies can provide support for form sections 81 even at times when concrete is to be poured thereon.

Figure 4:
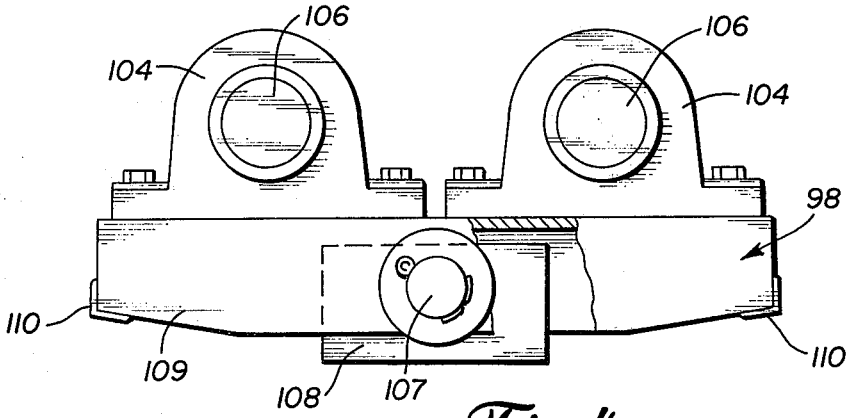
FIG. 4 is a side elevation in partial broken section showing additional features of a modified form of roll-out support or tilting form glide.

A preferred embodiment for a tilting form glide 98 is shown in FIG. 4. In this construction a plurality of pillow block bearing supports 104 are mounted on an inverted channel support structure. The bearing blocks 104 provide rotating support for paired rollers 106. A lower pivot 107 extends from the flange 109 of the top channel section of glide 98 to the opposite flange thereof. This pivot 107 rotatably joins the top channel and a bottom channel support 108 together in a manner facilitating tilting movement of the top channel with respect to such support. Angle pieces 110 extend from the flange 109 to the opposite flange of the top channel providing a limit stop for angular movements of the top channel with respect to any platform, such as a supporting deck 82, on which the lower channel 108 is supported. The use of this improved tilting form glide 98 is essentially the same as the illustrated use for the form glide 78, inasmuch as the rollers 106 are to be disposed under the bottom chords 13 of truss assemblies, such as the truss 83 shown in FIG. 5. When the lower channel 108 is positioned solidly on a supporting deck 82 adjacent an outer edge thereof, the truss section 83 and its associated form section 81 with deck 91 may be moved reciprocally to positions extended past the edges of the supporting deck where it may be conveniently handled by hoist apparatus for movement to alternate positions for reuse in continuing building operations or to a ground site for unitary shipment or for disassembly.

Where a plurality of rollers 106 are used, load concentrations are avoided. The trusses 83 are not subjected to concentrated loadings, and, accordingly, greater form or handling loads may be accommodated. Since the trusses will usually be supported at intermediate panel points when concrete decks are being poured, this reduction of concentrated loadings is of special advantage when a complete form section 81 is being moved from one point of use to another. If the form deck 91 of a typical form section 81 is held against an already poured concrete floor and the form section is, accordingly, extended more than half its length past the edge of a supporting slab 82, this improved double roller form glide 98 has a special beneficial usage, since concentrated loadings in this reverse stress condition for the truss are avoided.

Further improved embodiments in truss form handling equipment are shown in FIGS. 5 through 8. In FIG. 5 a form section 81 of construction similar to that of FIG. 1 is shown in an operative position on a supporting slab 82. The deck 91 of the form section 81 is again supported by joists 64 disposed above the top chord 12 of a combined truss 83. The lower chord 13 is supported at one end by tilting form glides 98 assembled in the manner illustrated in FIG. 4. The lower channel 108 sits directly on the slab 82 at an edge thereof, and the tilting form glide 98 can, accordingly, move pivotally about its pivot 107 as the entire form section 81 is moved reciprocally and outwardly to a position extended past the edge of the slab 82. During such movement the lower chord 13 will be rolled along the paired rollers 106 to such extended position. If the deck 91 tilts upwardly for engagement with a slab that has been poured or if spacers are maintained between such slab and the deck 91, the form section 81 can be moved to a position where more than half the length of the truss extends over the edge of the slab. In such condition it is noted that the paired rollers 106 will tend to reduce the concentrated loadings on the truss 83 and the strut and chord components thereof while the truss is in this reverse stress or cantilevered position.

Figure 8:
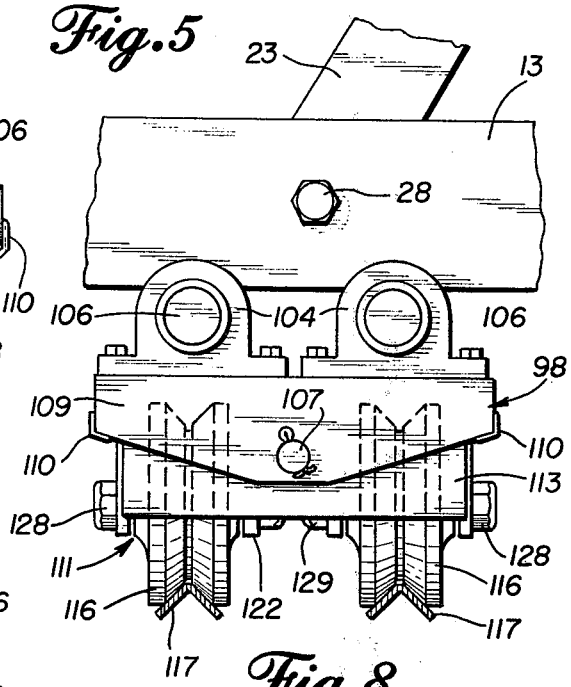
FIG. 8 is an end elevation showing the combined use of the elements of FIGS. 6 and 7 with the cross truck assembly of FIG. 7 now being in inverted position.
Figure 7:
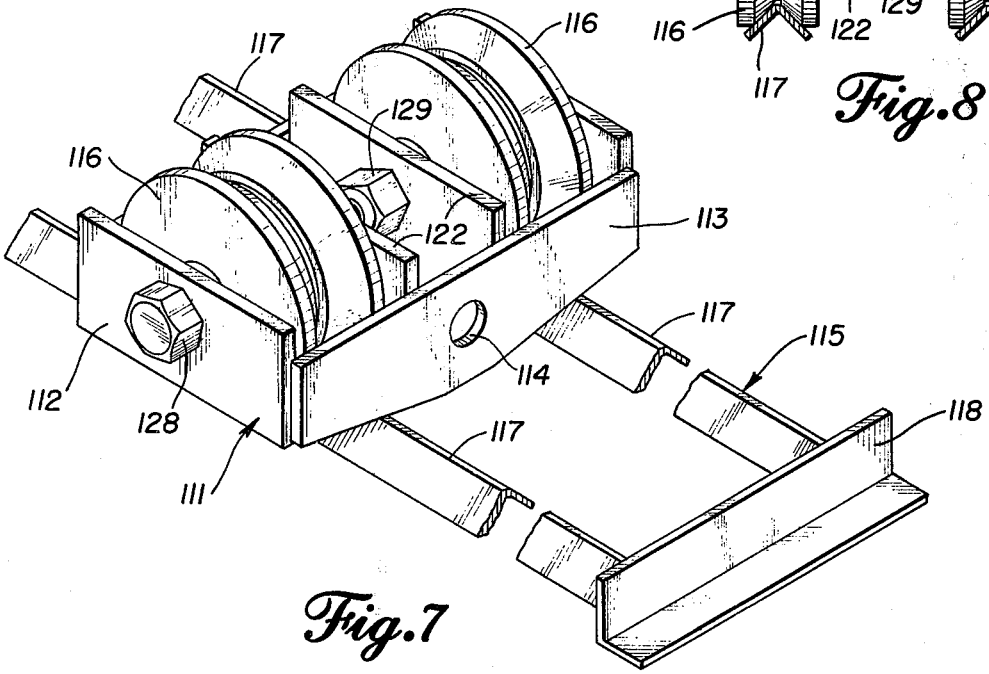
FIG. 7 is a perspective illustration of a cross truck assembly for use in moving the forms laterally or along a supporting track.

A lateral movement capability is provided at the other end of the truss 83 through use of the tilting form glide structure 98 in combination with a cross truck mount 111, the construction features of which are more fully shown in FIGS. 7 and 8 and a rail support component 115 similarly shown in FIGS. 7 and 8. Further details for the top channel components of the tilting form glide 98 are shown in the perspective illustration of FIG. 6. Combined use of such tilting form glide component and a cross truck mount 111 is shown in FIG. 8. In FIG. 8 the cross truck 111 is inverted with respect to its showing in FIG. 7. Cross truck 111 includes end frame components 112 and connector frame pieces 113. An opening 114 is provided in the connector pieces 113 through which the pivot pin 107 as provided in FIG. 4 may be extended to interconnect the tilting form glide 98 and the cross truck 111 to provide the combined structure shown in FIG. 8.

The cross truck assembly includes paired rail wheels 116, each of which are supported by pins 128 that extend through the center of such rail wheels and intermediate diaphragm frame elements 122. Incidentally, the pin 128 and the nut 129 used therewith can be identical with the pins 28 used to interconnect the struts 23 and the chords 12 and 13 of the truss 83. Inverting usage of the cross truck 111 is illustrated, since this truck 111 will have independent usage when it is disposed in the orientation illustrated in FIG. 7. When disposed in this position, the cross diaphragm elements 122 are spaced a distance apart so that the top surfaces thereof can be engaged beneath the bottom web 18 of any of the chords 13. When so engaged, the cross truck 111 could be moved along a rail system, such as the rail assembly 115 illustrated or directly along and in contact with a supporting slab 82 to facilitate longitudinal movements of the trusses and any supported form section.

When a lateral movement capability is desired, the cross truck 111 will be inverted for disposition beneath and within a tilting form glide such as the tilting form glides 98. The pivot pin 107 can then be extended to interconnect such assemblies in the manner illustrated in FIG. 8. When combined in this manner, the cross truck assembly 111 can be moved along a supporting rail system, such as the supporting rail assembly 115. If the rails are disposed in a transverse position as illustrated in FIG. 5, lateral movements of the form section 81 are possible. Such lateral movement capability is of considerable importance in the construction of many buildings having intermediate support columns. With such capability the form deck 91 can be built to include notches at the sides of the deck that will accommodate column forms or the poured and cured columns themselves. Where the forms would otherwise be locked in place due to column structures, partial disassembly of the form sections is not required if the form sections can be moved laterally before they are moved longitudinally to an extended position for subsequent handling by crane or other lift apparatus.

The rail sections 115 are of relatively simple construction. Rails of inverted angle iron pieces 117 are disposed so that the terminal edges of the flanges thereof will be in contact with the supporting deck. An angle piece 118 is used at the opposite end of a rail assembly 115 to join the rail elements 117 and to hold such elements in correctly spaced apart positions.

A further combined use of cross truck assemblies 111 and tilting form glides 98 is possible. If two cross truck assemblies 111 are used in the inverted configuration, as shown in FIG. 7, with the cross truck assemblies being spaced apart along the rails a distance corresponding to the outside flange-to-flange distance for the channel section 109 of tilting form glide 98, a single straight shaft (not shown) can be extended through the openings 114 of the connector frame pieces 113 for one cross truck 111, thence through the pivot openings in the flanges 109 for the tilting form glide 98 and then again through the openings 114 in the connector pieces 113 for the second cross truck. With this arrangement the tilting form glide 98 will be free for tilting movement about the through shaft. This configuration is especially useful where low building clearances are encountered, since the total height for this cross truck and tilting form glide combination is substantially less than that illustrated in FIG. 8. If the cross trucks 111 interconnected by through shafts are again disposed on supporting rail assemblies 115, a total form section 81 supported at four corners by such doubled cross truck and tilting form glide combination can be moved laterally or longitudinally to desired positions of use.

I claim:

1. Form handling equipment for moving the large form sections that are used in connection with the pouring of concrete deck and roof structures wherein the form sections are unitarily inclusive of form supporting trusses disposed beneath the form sections and wherein the bottom chords of said trusses have an uninterrupted planar lower face comprising a first channel section having its flanges disposed upwardly for use in contact with a level building support surface at a building site, truss chord receiving means inclusive of a rotatably mounted roller for contact with the lower planar face of said truss chords, a second channel section as a support for said truss chord receiving means and the roller thereof, said second channel section having its flanges disposed downwardly in mated position with respect to said first channel section, and a pivot element having an axis aligned parallel to said building support surface and extending through the flanges of said channel sections to facilitate movement of said roller to tilted positions as the truss is moved.

2. The form handling equipment as set forth in claim 1 wherein the truss chord receiving means includes a plurality of rotatable rollers for contact with the bottom face of said truss chord.

* * * * *